United States Patent [19]

Masse

[11] Patent Number: 5,007,269

[45] Date of Patent: Apr. 16, 1991

[54] WIRE BENDING DEVICE

[76] Inventor: Joseph H. Masse, 151 Coggeshall St., New Bedford, Mass. 02746

[21] Appl. No.: 440,037

[22] Filed: Nov. 21, 1989

[51] Int. Cl.[5] ..... B21D 7/00

[52] U.S. Cl. ..... 72/173; 72/170; 72/389

[58] Field of Search ..... 72/170, 173–175, 72/166, 171, 307, 386, 389

[56] References Cited

U.S. PATENT DOCUMENTS

| | | | |
|---|---|---|---|
| 2,640,525 | 6/1953 | Tourneau | 72/175 |
| 3,145,760 | 8/1964 | Brautigam | 72/174 |
| 3,395,846 | 8/1968 | Mille | 72/166 |
| 3,420,080 | 1/1969 | Supina | 72/175 |

*Primary Examiner*—Daniel C. Crane
*Attorney, Agent, or Firm*—Robert J. Doherty

[57] ABSTRACT

A device for bending metal wire or strips particularly adapted for arts and crafts creations in which a wire receiving gap is formed between a eccentrically driven forming pin and longitudinally and laterally separated guide pins disposed in relationship thereto. The elliptical driving pin movement allows the wire to be both formed and driven, that is, fed, into the device such that the craftsman may be free to manipulate the guide means to vary the gap as the work progresses. The elliptical movement of the driving pin is achieved by means of an actuating arm driven by a cam or equivalent system and including an adjustable pivot point to vary or control the amplitude of the elliptical movement.

7 Claims, 3 Drawing Sheets

WIRE BENDING DEVICE

BACKGROUND AND OBJECTS OF THE INVENTION

This invention relates to a device for bending wire, strip, etc. and more particularly to a device particularly adapted for arts and crafts such that wire may be bent into aesthetically pleasing shapes including spirals, circles, twists, and bends such that craft oriented articles may be formed thereform.

It is generally known in wire coiling that metal wire, strip and the like can be bent or coiled by the interaction of opposed sets of pins through which the stock is fed in a sinuous path to produce the desired bend. One such device is shown by U.S. Pat. No. 1,260,799 issued Mar. 26, 1918 in which a pair of pins 20 are adjustably disposed in relationship to a roller 24 such that the overall above-indicated object is accomplished. Furthermore in U.S. Pat. No. 4,164,133 issued Aug. 14, 1979, a further device is shown in which a roller 44 opposes a pair of rollers 42 and 43 and in which the single roller is adjustable to vary the sinuous or forming gap between the opposed rolls. These and other devices of a similar nature are primarily utilized for heavy industrial applications, and it would be desirable to be able to achieve bending metal wire or strips that are light weight in gauge in a relatively simple system without the necessity of heavy duty and complex adjustment and feed devices. Accordingly, a basic objective of the present invention is the provision of a device which, although utilizing the overall concept of opposed pins, drives the central pin in an elliptical fashion such that the pin can act as both a forming and driving mechanism so that the artisan may more easily manipulate the wire, etc. as well as the relative longitudinal positioning of the opposed pins to accomplish both straightforward and complex shaping techniques.

These and other objects of the present invention are accomplished by a device for bending wire, strip, etc. comprising a housing having a bending station in turn having an upstanding wire driving member, means including a generally elongated actuation arm having opposed ends for moving said driving member in an elliptical path in a plane generally normal to the upstanding orientation of said driving member, said bending station further including wire engaging guide means disposed in longitudinal opposition to said driving member and laterally extending further than the lateral extent of the travel path of said driving member whereby wire fed between said driving member and said guide means generally in said plane is contacted by said driving means and forced against said guide means.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
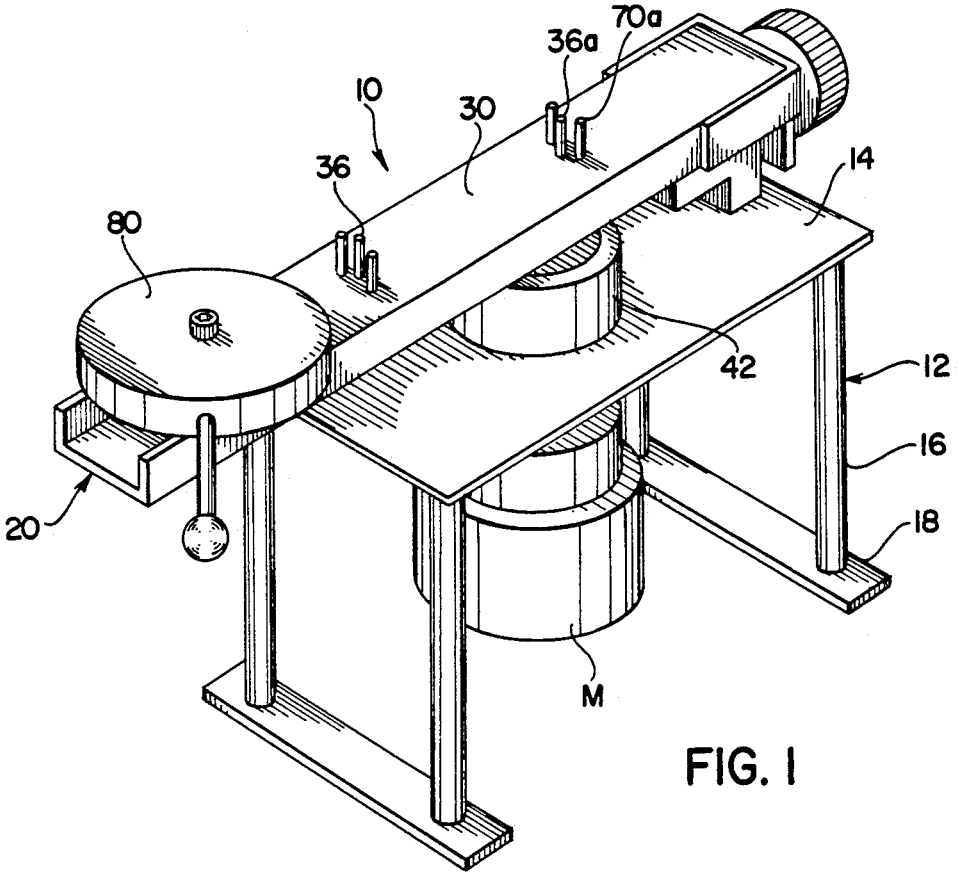
FIG. 1 is a stylized perspective view of the device of the present invention with parts removed and simplified for clarity.

Referring to the drawings, the device 10 of the present invention includes a housing 12 on which such is mounted or forms a part thereof. Such housing may include a platform having an upper wall 14, supporting legs 16, and a base or base legs 18 all formed from suitable metal plate or the like. The device 10 of the present invention may be appropriately mounted on the top surface 14 under which a motor M is housed to eccentrically drive an actuating arm on which a driving pin is mounted to provide the desired eccentric movement thereto as will hereinafter be more fully brought out.

The device 10 further includes an overall longitudinally oriented frame 20. The frame 20 includes a base wall 22 and upstanding side walls 24 and, in essence, accordingly forms a pocket 26 to receive the various other device components. In this manner, a convenient mechanism for housing and holding the various components is provided, although it should be brought out that other ways of housing or mounting the actuating arm on which the driving pin is mounted for operational engagement with the wire to be bent is contemplated.

Figure 2:
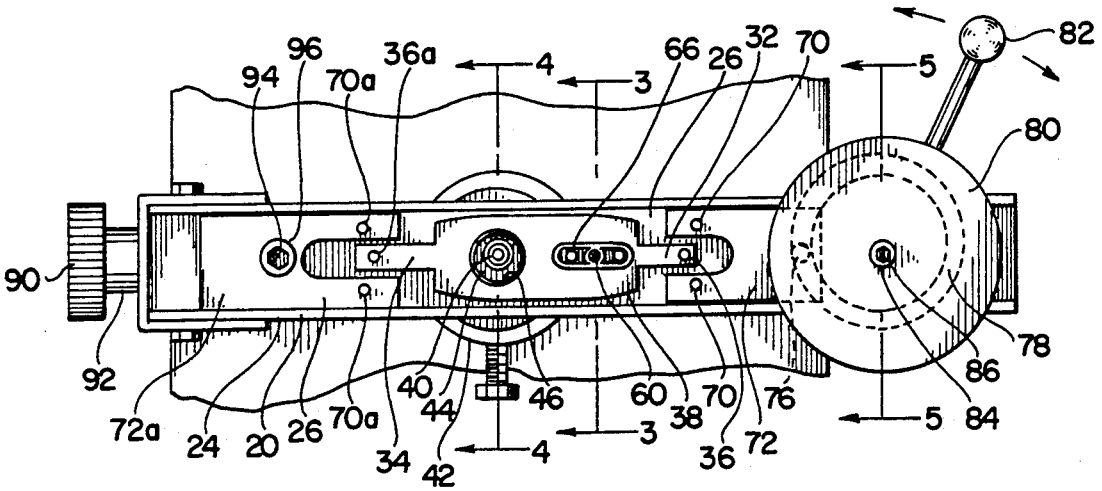
FIG. 2 is a top plan view thereof on an enlarged scale.
Figure 3:
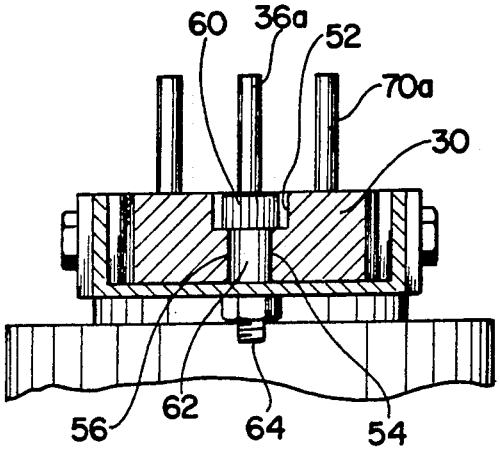
FIG. 3 is a partial sectional view along the line 3—3 of FIG. 2.
Figure 4:
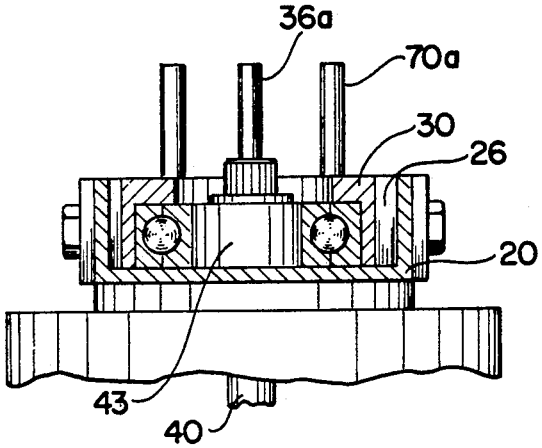
FIG. 4 is a partial sectional view along the line 4—4 of FIG. 2.
Figure 5:
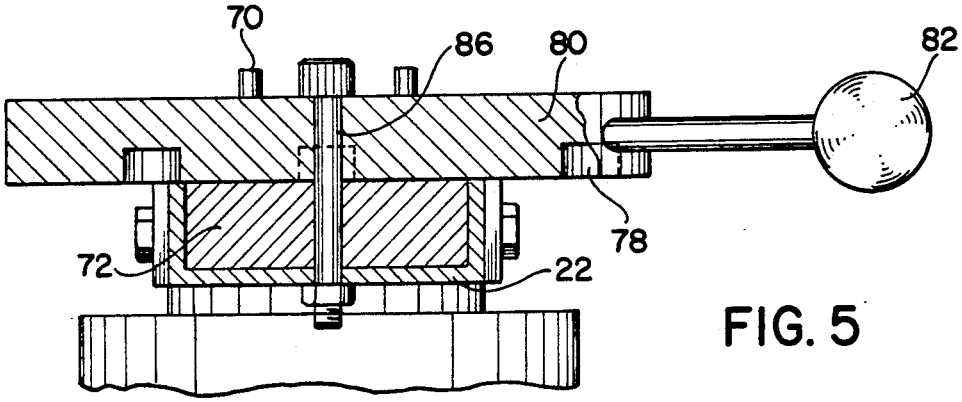
FIG. 5 is a partial sectional view along the line 5—5 of FIG. 2.

The actuating arm 30 is preferably centrally disposed within the recessed area or pocket 26 formed by the frame 20 and is spaced from the side walls 24 thereof such that the desired eccentric motion imparted thereto may take place. In this regard, the actuating arm 30 includes opposed ends 32 and 34. The first end 32 includes an upstanding driving pin 36. Generally the pin 36 is positioned normal to the overall flat upper surface 38 of the actuating arm 30 since it is generally contemplated that the wire W will be fed laterally across that portion of the actuating arm disposed in front of the driving pin 36, that is, to the right thereof as shown in FIG. 2. To provide such motion, the shaft 40 of the motor end projects upwardly through a positioning member 42 mounted on the upper surface of the platform 14. The shaft 40 includes a cam 43 positioned within an elliptical cam well 44 positioned in the actuating arm itself such that rotation of the shaft 40 rotates the cam 43 and through such rotation imparts a longitudinal reciprocating and elliptical movement to the actuating arm 30. In order to control, regulate or adjust the extent of this elliptical movement as it is transmitted to either the first end 32 or the second end 34 of the actuating arm 30, pivot means 50 are included.

Such pivot means 50 include a longitudinally oriented slot 52 and a second or lesser extent slot 54, that is, the larger slot 52 projects partially through the thickness of the actuating arm 30 from the top while the lesser extent slot projects the remaining portion through to the bottom thereof. The opposed sides 56 of the smaller slot 54 in effect form pivot surfaces against which the sleeved central portion of a bolt 58 contacts. The bolt 58 includes a head 60, a sleeved central portion 62, and a threaded lower portion 64 which extends into one of several threaded openings provided through the base 22 within the extent of the smaller slot 54 such that longitudinal adjustment of the pivot point formed by the coaction between the sleeve 62 and the opposed slot sides 56 is achieved. In other words to vary the pivot point in effect formed by such above-described contact, the bolt 58 may merely be moved to different openings 66. In this manner then, the length of the pivot arm and, accordingly, the lateral motion imparted to either of the ends 32 or 34 of the actuating arm is controlled for any particular cam configuration. Generally the desired motion to be imparted to the first end 32 and, accordingly, the driving pin 36 is one that can be varied to a fairly lateral elliptical movement or a fairly longitudinal elliptical movement depending on the shape types desired to be produced to the wire.

While it is possible to obtain successful device operation with the driving pin 36 operating against a pair of guide pins 70 which are fixed in position, it is preferable that such pins 70 or other guide means be longitudinally adjustable. It is also contemplated that guide means other than a pair of laterally opposed spaced pins 70 may be utilized if desirable. Accordingly, the pins 70 are upwardly disposed on a bifurcated block 72 having arms 74 spaced such that the narrowed first forward end 32 of the actuating arm may extend therebetween and also provide enough lateral space such that the lateral eccentric movement of such end 32 is accommodated. The block 72 is free to longitudinally move within the constraints of the recess 26 as provided by the opposed walls 24 of the frame 20. Such block 72 includes an upstanding cam follower 76 positioned within an eccentric recess 78 formed in the under surface of a circular adjusting member 80 in turn provided with a hand grasping handle 82. The adjusting member 80 includes a central opening 84 through which a bolt 86 downwardly projects and in turn fastened by such bolt to the lower wall 22 of the frame 20. In this fashion, the adjusting wheel or member 80 is free for relative back and forth rotation such that the rotation in turn provides a longitudinal reciprocating type adjustment to the block 72 and in turn to the pins 70 so the gap between the pins 70 and 36 may be varied to accomplish various bending forms or progressions to the wire as it is fed.

The other or second end 34 of the actuating member 30 is also provided with a pin **36*a* which similar to the driving pin 36 is driven in an elliptical reciprocating motion but of a varied amplitude due to the different distance between its position and that of the pivot point formed by the interaction between the sleeve 62 and the slot sides 56. This second driving pin 36*a*, of course, could be omitted including its guide means as will hereinafter be more fully explained, but it enables the device 10 of the present invention to accomplish various types of wiring bending techniques in the same device, that is, the first end 32 with its hand manipulated guide means can be utilized for projects in which the bend or shape imparted to the wire varies as the article is formed whereas the second end 34 can be utilized, for instance, in more long run projects that do not require varying the longitudinal attitude of the guide means 70*a* during device operation or one in which more reproduceable setting are required. Accordingly, the second guide means pins 70*a* are provided with a similar sliding block 72*a* which in turn is connected to a adjustment wheel 90 via a connecting tongue 92. The rotary tongue 92 may be moved through a threaded opening (not shown) through the frame 20; and, accordingly, the reciprocating adjustment achieved in that manner. When the desired position is arrived at, that position may be locked simply by turning a clamp screw 94 which extends through the plate 72*a* and is provided with a enlarged head 96 which may by such tightening be forced down upon a collar or ledge to force the block 72*a* against the bottom surface 22 of the frame 20** on which it rests. Obviously, other tightening mechanisms may be utilized and are contemplated herein.

Figure 6:
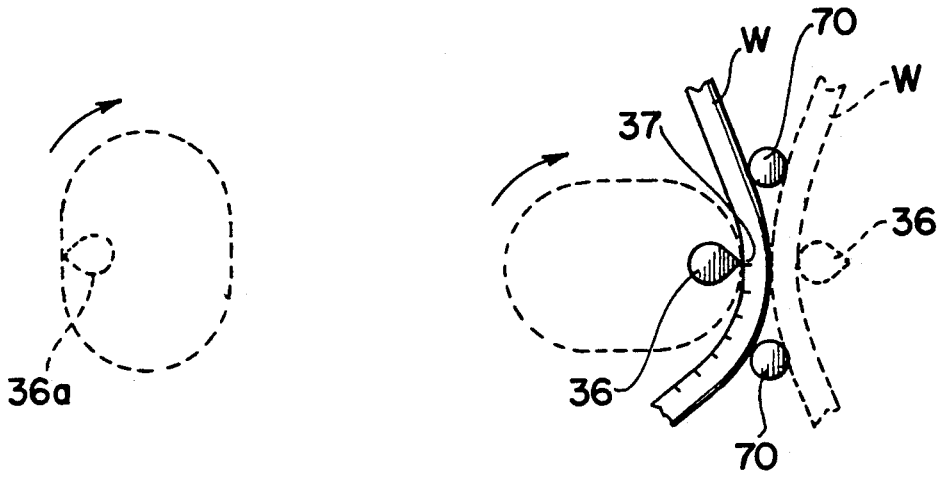
FIG. 6 is a stylized view of the wire bending and driving action.

Accordingly and by reference to FIG. 6, the wire W may be fed between the gap provided by the pins 36 and 70 such that spirals, bends, twists, and the like may be formed in the wire. Preferably one side of the pin 36 is provided with a sharpened edge 37 such that the edge as it elliptically moves pass the wire may, in effect, bite into the wire thus driving it along by repeated engagement therewith, that is, as the pin rotates, it will contact the wire once each revolution and, accordingly, bitingly engage such so as to drive it in the direction desired while still imparting bend characteristics sought. As shown in FIG. 7, by adjusting the guide means pins 70 such that they are moved to a position rearward of the drive pin 36 or **36*a*, the wire may be fed between a gap which is thus shifted to the inward side of the pin 36 or 36*a* instead of the outward side as shown in FIG. 2. This is particularly of interest when the pin is provided with a sharpened edge 37 such that the sharpened edge is effective in engaging the wire receiving gap is forward of the pin and a smooth side of the pin opposite the edge engaging the wire when the wire receiving gap is rearward or inboard of the pin 36 or 36*a***.

Also by altering the configuration of the frame or other support, more than the two ends shown may be accommodated, for instance, the frame could be star shaped and accommodate four or more working ends. Also, it should be pointed out that positioning member 42 can be rotated such that either working end (or any working end when more than two) is positioned in front of the artisan and locked in such position by a set screw.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for bending wire, or strip comprising a housing having a bending station, said housing including a generally elongated horizontally disposed frame having a flat upper generally horizontal surface in part forming said bending station and defining the plane of movement through which said wire moves while being bent, said bending station further including a generally vertically oriented driving pin projecting upwardly through said plane and freely terminating thereabove and guide means including a pair of laterally-spaced vertically-oriented guide pins projecting upwardly through said plane and freely terminating thereabove and disposed laterally to opposite sides of said driving pin so as to form a wire path laterally extending across said bending station frame upper surface within said plane whereby wire fed laterally in said plane to said bending station between said driving pin and said guide pins is contacted by said driving pin and forced against said guide pins so as to bend such wire, said frame including a generally elongated actuation arm having opposed ends longitudinally disposed therein and having at one end thereof said driving pin mounted thereto, means for moving said actuating arm in a longitudinal reciprocating motion including a cam eccentric and pivot means in said actuating arm for regulating the lateral motion of said one end, said wire engaging guide pin means disposed in longitudinal opposition to said driving member and laterally spaced from the driving pin extending further than the lateral extent of the eccentric travel path of said driving pin.

2. The device of claim 1, said frame being in turn mounted to a support surface and adjustably rotatable to various work positions relative to said support surface.

3. The device of claim 1, said frame having a second wire guide means disposed at the other end thereof and a second wire driving pin disposed at the opposite end of said actuating arm.

4. The device of claim 1, said guide means being longitudinally adjustable to vary the longitudinal gap between said driving member and said guide means.

5. The device of claim 1, said driving pin having a pointed edge to dig into said wire as the driving pin is eccentrically rotated.

6. The device of claim 4, said pivot means including an open slot having opposed sides in said actuating arm into which a longitudinally adjustable pivot pin extends for contact with the opposed sides of said slot.

7. The device of claim 4, said guide means in turn connected to a handle for quickly moving said guide means towards and away from said driving pin.

* * * * *